United States Patent [19]

Hawkinson et al.

[11] Patent Number: 4,729,481

[45] Date of Patent: Mar. 8, 1988

[54] APPARATUS FOR ADVANCING SHELVED GOODS

[75] Inventors: Rodney B. Hawkinson, Napa; Julius A. Sarto, San Jose, both of Calif.

[73] Assignee: PCR Company, Napa, Calif.

[21] Appl. No.: 817,567

[22] Filed: Jan. 10, 1986

[51] Int. Cl.[4] ..... A47F 7/00

[52] U.S. Cl. ..... 211/59.3; 221/279

[58] Field of Search ..... 211/59.3, DIG. 1; 221/279, 280, 53, 227

[56] References Cited

U.S. PATENT DOCUMENTS

| | | | |
|---|---|---|---|
| 2,079,754 | 5/1937 | Waxgiser | 211/59.3 X |
| 2,652,154 | 9/1953 | Stevens | 211/59.3 |
| 3,302,827 | 2/1967 | Maslow | 211/59.3 X |
| 3,348,732 | 10/1967 | Schwarz | 221/279 X |
| 3,767,084 | 10/1973 | Bayha | 221/279 |
| 4,042,096 | 8/1977 | Smith | 221/279 X |
| 4,351,439 | 9/1982 | Taylor | 211/59.3 |

FOREIGN PATENT DOCUMENTS

| | | | |
|---|---|---|---|
| 1107460 | 3/1968 | United Kingdom | 211/59.3 |

*Primary Examiner*—Carl D. Friedman
*Assistant Examiner*—Naoko N. Slack
*Attorney, Agent, or Firm*—Melvin R. Stidham

[57] ABSTRACT

Apparatus for advancing packaged goods on a shelf comprises an upright pressure plate carried on the end of a flexible belt. The belt is carried on a roll which is spring biased to wind the belt thereon so that a row of articles positioned along the belt and engaged by the pressure plate will be pushed toward the front of the shelf as each successive article is removed.

6 Claims, 4 Drawing Figures

APPARATUS FOR ADVANCING SHELVED GOODS

BACKGROUND OF THE INVENTION

It is well established that the prominent display of merchandise in sales establishments, such as supermarkets, does much to enhance sales. As a result, store attendants are constantly moving merchandise to the fronts of the shelves, particularly on shelves situated above eye level where articles at the rear may go unnoticed.

Some packaged products are displayed on inclined shelves so that, as an article is removed from the front, articles behind slide or roll forward to replace it. However, certain products, such as potato chips and similarly bagged goods without a flat base, are quite unstable in stacking and may simply topple over when unsupported by an adjacent article.

OBJECTS OF THE INVENTION

It is an object of this invention to provide apparatus for advancing shelved goods as articles in front are removed.

It is a further object of this invention to provide apparatus for holding irregularly shaped, bagged goods erect and in prominent display until the last article on the shelf is removed.

It is a further object to provide apparatus for supporting and advancing packaged goods on store shelves of various depths.

Other objects and advantages of this invention will become apparent from the description to follow, particularly when read in conjunction with the accompanying drawing.

SUMMARY OF THE INVENTION

In carrying out this invention, we provide a flexible strip or belt, which is reeled onto a roll mounted at the front of a shelf. The belt extends toward the rear of the shelf so that a row of packaged items may be placed thereon. A torsion spring biases the roll to reel the belt in, and a pressure plate on the end of the belt engages behind the rearmost article. Hence, as each article is removed from the front, the pressure plate advances the remaining packages in the row to the front of the shelf.

DESCRIPTION OF A PREFERRED EMBODIMENT

Figure 1:
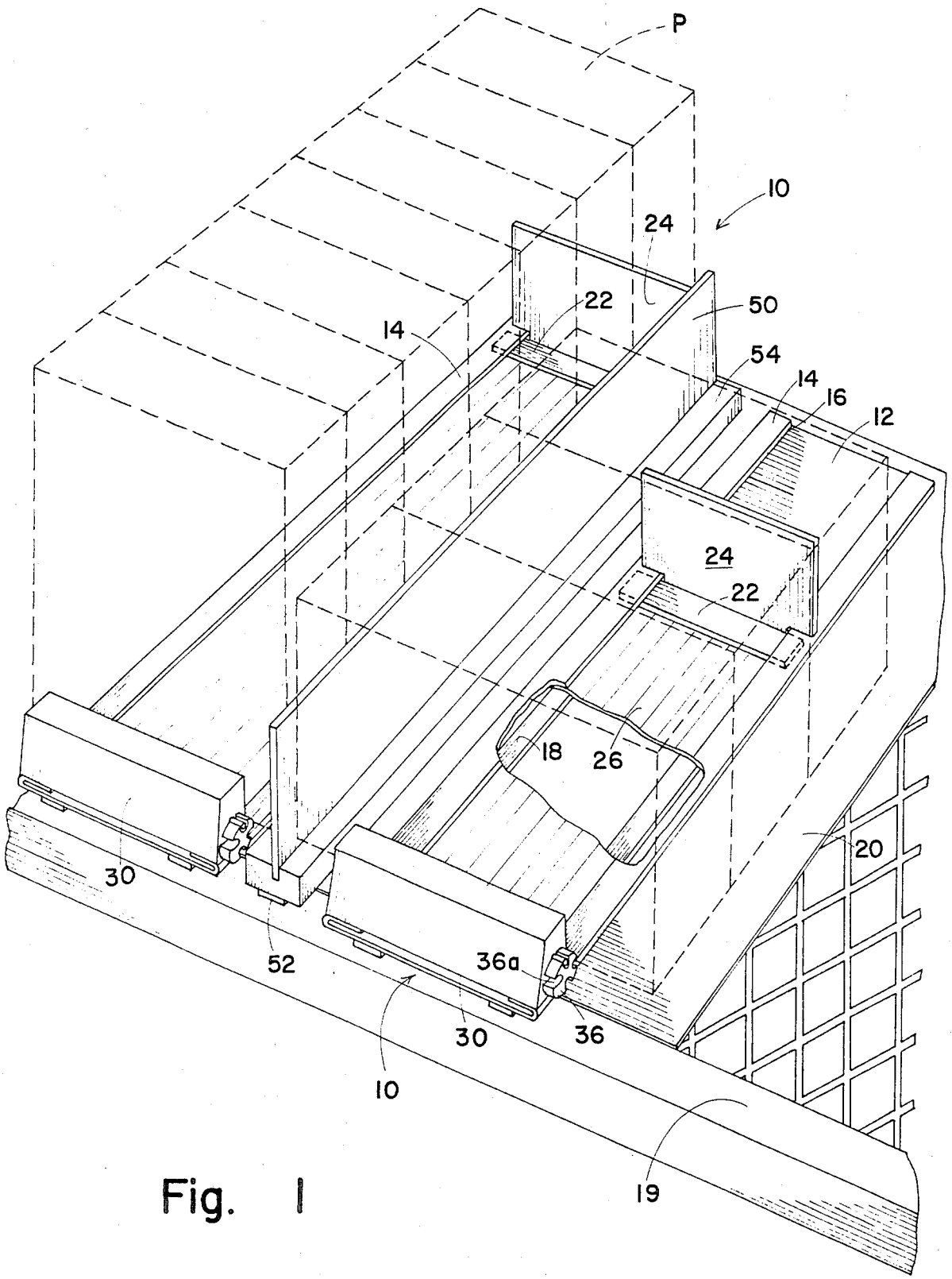
FIG. 1 is a view in perspective showing the apparatus of this invention in operation.

Referring now to the drawing with greater particularity, each device 10 of this invention includes an elongated base plate 12 with its side margins 14 turned over toward each other to form a slideway 16. Elongated magnets 18 are secured to the bottom of the base plate 12 of each device 10 to secure the base plate in place on a shelf. Preferably, a sheet of thin sheet steel 20 is placed on the shelf to enhance the magnetic attraction.

Slidably mounted in the inturned margins is a slide 22 on which is carried an upright pusher member or pressure plate 24 to engage behind a row of packaged goods P to push them toward the front of the shelf 20, as will hereinafter be described.

Figure 2:
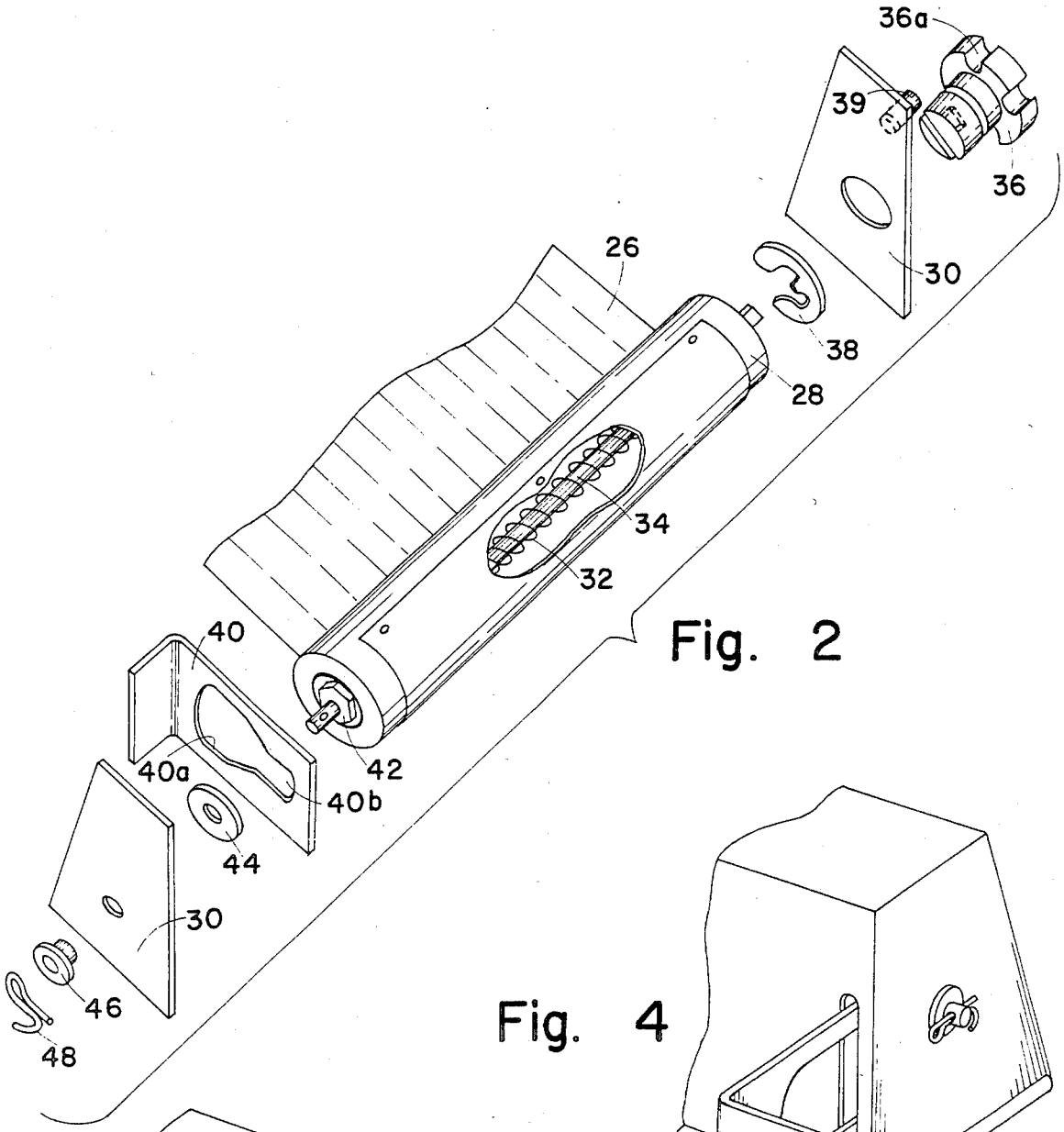
FIG. 2 is an exploded view in perspective showing the components of this invention.
Figure 4:
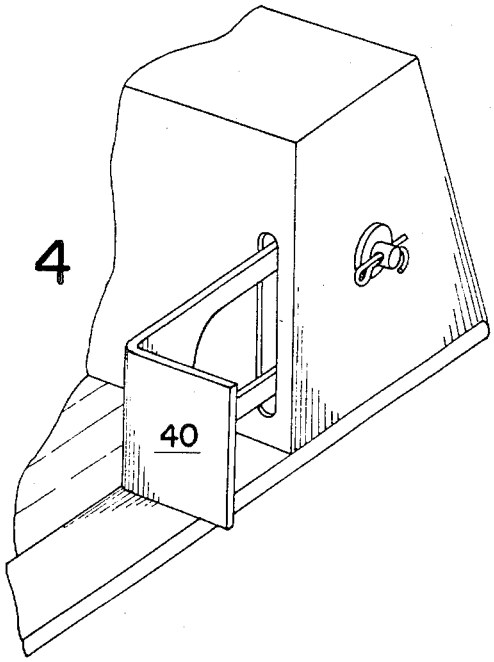
FIG. 4 is a partial view in perspective showing the row locking device.
Figure 3:
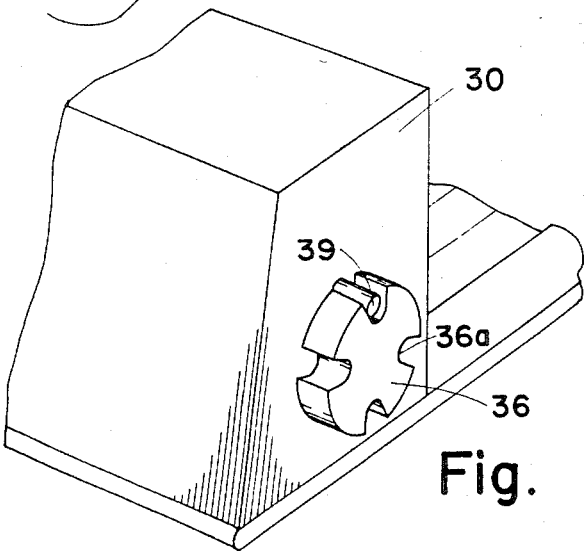
FIG. 3 is a partial view in perspective showing the tension control.

The pressure plate 24 is carried on a belt 26 of a flexible sheet material, such as coated fabric or a suitable plastic. The belt 26, in turn, is secured to and wound onto a roll 28 (FIG. 2), which is rotatably carried in a base member 30 mounted on the front of the base plate 12. A torsion coil spring 32 in the roll 28 is biased between a central rod 34 and the cylindrical roll 28 to bias the roll 28 to wind the flexible sheet 26 thereon, in the nature of a window shade.

A knob 26 carried on one end of the rod 34 and secured in place by a clip 38 may be turned so that a selected notch **36*a* engages on a small pin 39 on the base housing to adjust the force of the spring 32. On the other side of the base housing 30 a slidable lock plate 40 engages over a hexagonal member 42 secured to the roll 28. When the lock plate 40 is pulled toward the front of the housing 30, the male member 42 is free to rotate in the englarged opening 40*a*. However, when the lock plate 40 is pushed toward the rear, the reduced opening 40b engages on the flat portions of the hexagonal member 42 to lock the cylindrical roll 28 against rotation. Hence, the belt 26 can be locked in any position to which it may be pulled for loading articles thereon. After the rod 34 is inserted through washers 44 and 46, it is secured in place by a cotter pin 48**.

Since all of the operating components are housed in the base member 30 at the front of the package-advancing device 10 the slideway 12 may be made of extra length and then cut off as needed to fit shelves 19 of a wide range of depths.

In operation, the pressure plate 24 may be pulled to its full extent away from the base housing 30 and then the lock plate 40 is pushed rearward to hold the roll 28 against rotation. This holds the push plate 24 stationary so that packaged articles P, such as boxes, bags and the like can be stacked onto the conveyor belt 26 or the margins 14 of the base plate 12. Then, the lock 40 is released and the pressure plate 24 engages and presses firmly against the rearmost article P. Thereafter, as each article is removed from the front of the shelf, the pressure plate 24 pushes the remaining articles in the row forward against the base housing 30 so that there is always a package visible at the front of the shelf.

As shown in FIG. 1, a plurality of these devices 10 of this invention may be placed on a single shelf 19, side by side. Also if desired, the articles may be separated by a divider panel 50, which is secured to the shelf 19 by means of an elongated magnet 52 carried on the bottom of the base 54.

While the invention has been described in conjunction with a preferred embodiment thereof, it is obvious that modifications and changes therein maybe made by those skilled in the art to which it pertains without departing from the spirit and scope of this invention, as defined by the claims appended hereto.

What is claimed as invention is:

1. Apparatus for advancing shelved goods comprising:

a base member adapted to be mounted at the front of a shelf;

a cylindrical roll rotatably mounted on said base member;

a flexible belt secured to and extending rearward from said cylindrical roll;

means biasing said cylindrical roll to reel said flexible belt thereon;

an upright pusher member carried on the end of said belt to engage behind a row of articles positioned along said belt; and lock means, selectively operated with said pusher member in any position, to secure said roll against rotation;

said lock means being mounted on said base member for movement thereon between a locking position wherein portions thereon engage portions on said cylindrical roll to prevent rotation of said roll and a neutral position wherein said portions are free of engagement.

2. The apparatus defined by claim 1 including:

a longitudinal slideway secured to and extending rearward from said base member; and a slide member slidably received in said slideway;

said slide member being secured to the end of said flexible belt and carrying said pusher member.

3. The apparatus defined by claim 1 including:

means for adjusting the force of said biasing means.

4. The apparatus defined by claim 1 including:

a coaxial rod within said cylindrical roll;

said cylindrical roll being rotatable on said rod;

a coil spring secured between said cylindrical roll and said rod.

5. The apparatus defined by claim 1 wherein:

said lock means comprises:

a lock bar longitudinally slidable on said base member;

a polygonal member concentrically mounted on one end of said cylindrical roll;

a wide slot in said lock bar receiving said polygonal member for free rotation therein in one position of said lock bar; and a narrow slot extending longitudinally from said wide slot and snugly receiving said polygonal member and engaging opposite sides thereof in a locking position of said lock bar.

6. Apparatus for advancing shelved goods comprising:

a slideway adapted to be mounted on a display shelf to extend from front to rear thereof;

a slide member slidably received in said slideway;

a pressure plate carried by said slide member;

a cylindrical roll rotatably mounted on said slideway;

a flexible tension member wound on said roll and secured at the distal end thereof to said slide member;

means biasing said cylindrical roll to wind said tension member thereon; and lock means, selectively operated with said slide member in any position, to secure said roll against rotation.

said lock means being mounted on said base member for movement thereon between a locking position wherein portions thereon engage portions on said cylindrical roll to prevent rotation of said cylindrical roll, and a neutral position wherein said portions are free of engagement.

* * * * *